US006393742B1

(12) United States Patent
Dix

(10) Patent No.: US 6,393,742 B1
(45) Date of Patent: May 28, 2002

(54) MINIMUM CONTACT FRAME

(76) Inventor: Kathryn H. Dix, 8027 Fontana, Prairie Village, KS (US) 66208

( * ) Notice: Subject to any disclaimer, the term of this patent is extended or adjusted under 35 U.S.C. 154(b) by 0 days.

(21) Appl. No.: 09/517,868

(22) Filed: Mar. 2, 2000

(51) Int. Cl.[7] ..... D06C 3/08
(52) U.S. Cl. ..... 38/102.91; 160/374.1
(58) Field of Search ..... 38/102, 102.1, 38/102.91; 101/127.1, 128.1, 128; 160/374.1, 375, 378, 381

(56) References Cited

U.S. PATENT DOCUMENTS 2,429,256 A * 10/1947 Block ..... 38/102.91
2,456,225 A * 12/1948 Thomas ..... 38/102.91
3,238,996 A * 3/1966 Munn ..... 160/374.1
3,978,905 A * 9/1976 De Lama et al. ..... 38/102.91 X
5,115,584 A * 5/1992 Lucchetti ..... 38/102.91
5,133,140 A * 7/1992 Frey ..... 38/102.91
5,502,906 A * 4/1996 Yamawaki ..... 38/102
5,517,775 A * 5/1996 Kurtz ..... 38/102.91
5,579,595 A * 12/1996 Dutton ..... 38/102.1

FOREIGN PATENT DOCUMENTS

WO 2020535 * 11/1992 ..... 38/102.91

* cited by examiner

*Primary Examiner*—Ismael Izaguirre
(74) *Attorney, Agent, or Firm*—Shook, Hardy & Bacon L.C.

(57) ABSTRACT

A stretcher bar framing device having a narrow top surface, an interior surface, an exterior surface and an angled edge such that a stretched canvas touches only the top surface. The top surface provides a surface for supporting a painting canvas, reducing the surface area contacting the canvas and increasing the paintable surface. A bottom surface of the frame contains a channel so that the canvas material is folded over the top along an exterior surface and folded into a channel so that a rubber spline may be inserted attaching the canvas to the frame without the need for staples.

4 Claims, 2 Drawing Sheets

FIG. 1.
PRIOR ART
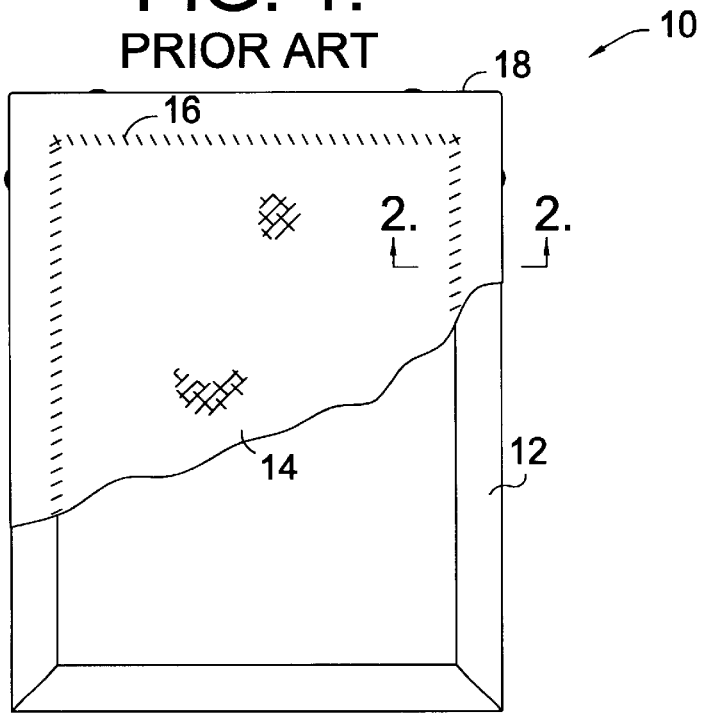
FIG. 2.
PRIOR ART
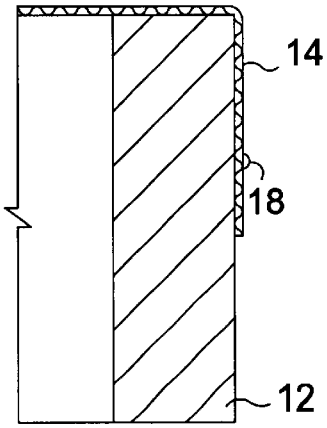
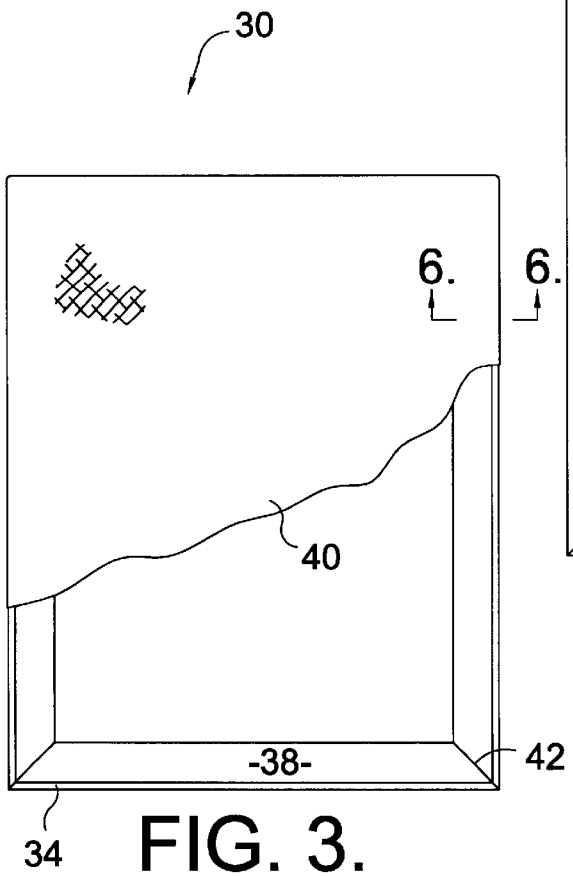
FIG. 3.
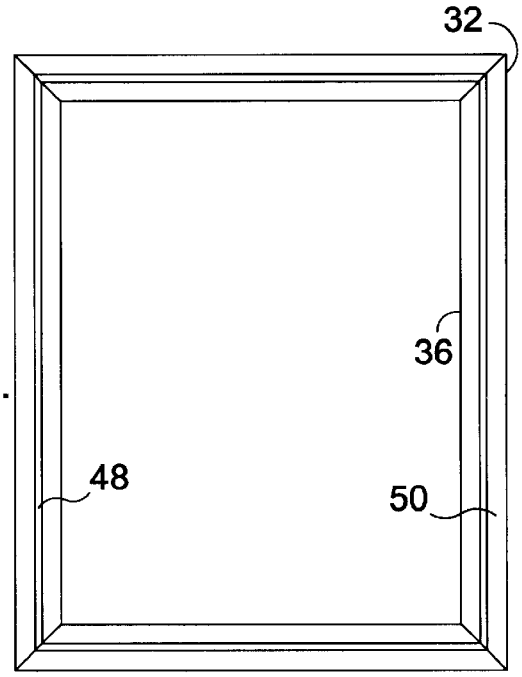
FIG. 4.

FIG. 5.
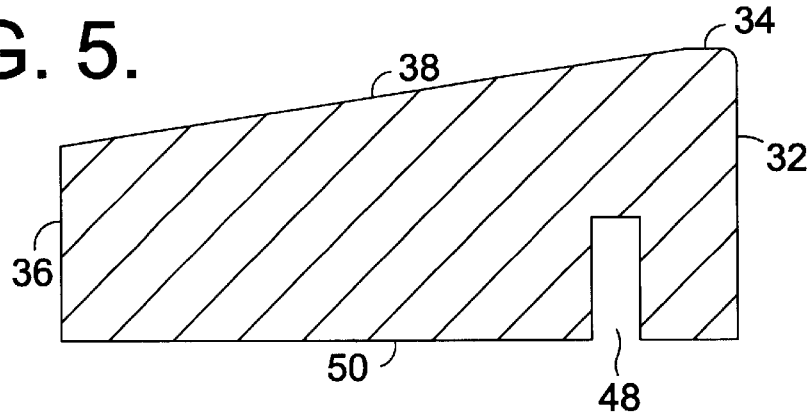
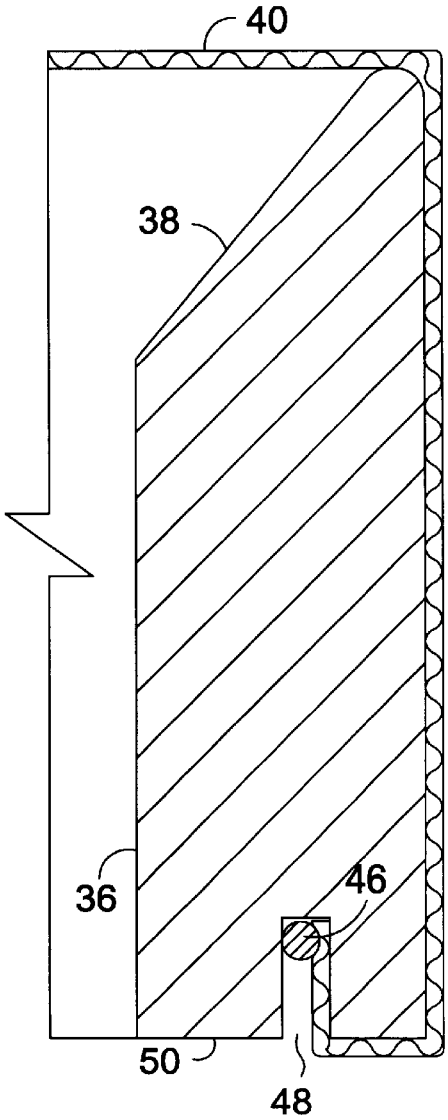
FIG. 6.
FIG. 7.
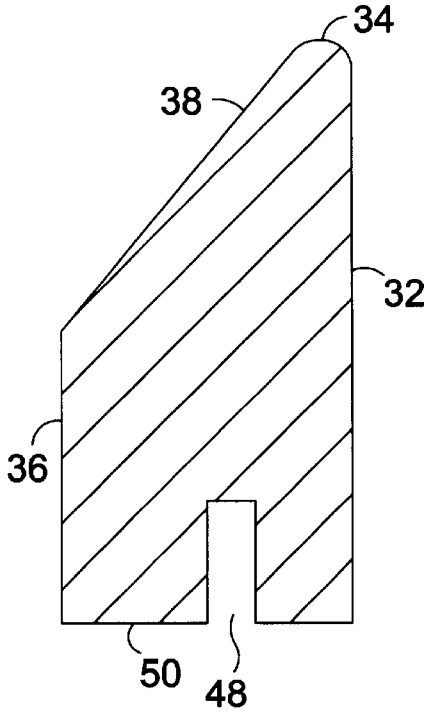

MINIMUM CONTACT FRAME

TECHNICAL FIELD

In general, this invention relates to a stretcher bar frame and more specifically, to an angled stretcher bar frame producing a minimal contact with a stretched canvas.

BACKGROUND OF THE INVENTION

In general, conventional frames have a flat framing structure profile. These conventional frames typically include a front surface whose area is defined by the thickness of the material used to construct the frame. In such frames, a more sturdy framing surface results in a thick front surface.

When a canvas or other material is mounted on a prior art frame, the material is stretched across the top surface with a tautness sufficient to allow an artist to paint on the material. Accordingly, prior art frames have a central portion in which there is no underlying structure supporting the material. As the material spreads outward toward the edge of the frame, it comes in contact with the front surface of the frame and eventually wraps around the perimeter of the frame. Where the top surface contacts the frame, the canvas is no longer taut, but becomes stiff. Typically, artists do not paint directly underneath the hard surface as there is a noticeable line where the canvas meets the edge of the frame. This is also true in mounting a picture on a similar frame as there will be a line where the frame meets the material being mounted.

After an artist's canvas is stretched across a flat profile frame, the canvas is typically fixed to the prior art frame by attaching staples alongside the edge. These staples can be awkward, unsightly or present a potential safety risk, as a user may be cut by the projecting staples.

Based on the above-mentioned deficiencies in the conventional framing structures, there is a need for a stretcher bar frame structure that increases the amount of usable canvas or mounting space by minimalizing the contact between the material mounted on a frame and the underlying framing structure. Additionally, there is a need for a stretcher bar framing structure that can have material attached to it without the need for staples or other fastening means.

SUMMARY OF THE INVENTION

The present invention satisfies the above-mentioned need by an angled stretcher bar frame having a profile to produce a minimal contact with a stretched canvas and with a channel in a bottom surface to secure the stretched canvas without requiring use of staples.

Generally, the present invention provides a stretcher bar frame. The frame includes a substantially vertical exterior surface, a substantially vertical interior surface, the interior surface substantially parallel to the exterior surface, a substantially horizontal top surface, the top surface abutting an upper portion of the exterior surface, and an angled surface, the angled surface coupled to the top surface and to an upper portion of the interior surface.. Additionally, the angled surface defines a profile of the frame, the profile angled such that the angled surface and the interior surface do not break a horizontal plane intersecting the top surface.

In another aspect of the present invention, a stretcher bar frame is provided. The stretcher bar frame includes a substantially horizontal top surface, the top surface having an interior edge and an exterior edge, an angled surface, the angled surface abutting the interior edge of the top surface, and angled downward relative to the top surface, and a sheet of material covering the top surface, and overlapping the exterior edge of the top surface. Moreover, the angled surface defines a profile of the frame, the profile angled such that the angled surface and the interior surface do not contact the material.

In a further aspect of the present invention, a stretcher bar frame is provided. The stretcher bar frame includes a top edge and an interior edge, wherein the top edge and the interior edge define an angled profile. The angled profile is angled such that only the top edge contacts a horizontal plane intersecting the top edge.

When utilizing the present invention in a painting, an artist typically paints solely on the stretched, taut canvas, not painting on any canvas portion that has a wood support directly underneath. Because the canvas surface is held taut solely at the top surface edges, and the angled portion does not touch the canvas in any way, the present invention increases the surface area in which an artist may effectively paint on a stretched canvas.

BRIEF DESCRIPTION OF THE DRAWING

Objects and features of the invention noted above are explained in more detail with reference to the figures, and in which like referenced numerals are use to indicate like parts in the various views:

FIG. 1 is a front elevational view of the prior art;

FIG. 2 is a side view of the prior art;

FIG. 3 is a front elevational view of the stretcher bar framing device of the present invention;

FIG. 4 is a back elevational view of the stretcher bar framing device of the present invention;

FIG. 5 is a side view of the stretcher bar framing device of the present invention;

FIG. 6 is a side view of the stretcher bar framing device of the present invention;

FIG. 7 is a side view of the stretcher bar framing device of the present invention.

DETAILED DESCRIPTION OF THE INVENTION

For a better understanding of the present invention, reference may be had to the following detailed description taken in conjunction with the printed claims and accompanying drawings.

FIGS. 1 and 2 are representative of prior art framing devices, denoted generally by the numeral 10. A typical prior art frame consists of multiple framing workpieces 12 which, as designated in a cross section in FIG. 2, are a rectangular flat pieces. As a canvas 14 is stretched over the workpieces 12, the center of the canvas 14 is taut with nothing underneath. However, where the canvas meets the edge of the profile an indentation occurs, designated generally at 16. This indentation 16 is caused by the pressure of the end of the workpiece 12 on the taut canvas 14. The canvas 14 is then secured to the frame 10 by use of staples 18.

FIG. 3 is a front elevational view of the stretcher bar framing device of the present invention, denoted generally by the numeral 30. The stretcher bar framing device 30 is composed of multiple workpieces having matching surface structures. The shape of the stretcher bar frame 30 is defined by exterior surface 32. In the preferred embodiment, the shape of the frame 30 is a rectangle entailing two sets of opposite facing workpieces. As would be understood by anyone skilled in the relevant art, different shaped framing structures are included within the scope of the present invention and would require a different number of external surfaces and/or different configuration of those surfaces. Such other configurations include varied geometric shapes such as octagons, triangles, circles and squares or could include outlines of objects such as a star or a helmet.

FIGS. 5, 6 and 7 denote different embodiments and dimensions of the stretcher bar framing device of the present invention. As best seen in the side view, each workpiece has a top surface 34 which defines a narrow edge around the perimeter of the frame. The top surface 34 is adjacent external surface 32 and provides a minimal horizontal surface. It will be understood that top surface 34 may be rounded or contoured to improve its use as a guide surface for a canvas.

The stretcher bar framing device 30 also has an interior surface 36 which is parallel to exterior surface 32. As noted in the three different embodiments, the ratio of the height of the exterior surface 32 to the height of the interior surface 36 may vary. However, the height of interior surface 36 will always be less than the height of exterior surface 32.

Top surface 34 is connected to interior surface 36 by angled surface 38. Angled surface 38 defines the profile of the stretcher bar framing device 30. As can be seen in the different embodiments, the angle of the profile varies, but the angle is sufficient so that no part of angle surface 38 contacts a horizontal plane intersecting top surface 34. Because interior surface 36 and angled surface 38 are always at a lesser height than top surface 34, top surface 34 defines the tallest point of stretcher bar framing device 30.

FIG. 4 is a back elevational view of the stretcher bar framing device of the present invention. The stretcher bar framing device 30 has a bottom surface 50 which is opposite of angled surface 38. The thickness of bottom surface 50 is the distance between interior surface 36 and exterior surface 32. Bottom surface 50 is generally planer and provides a flat bottom for the framing device 30. Located on the face of bottom surface 50 is channel 48 which generally runs parallel to interior surface 36 and exterior surface 32. The channel 48 can be of a varied depth and will typically not be greater than the height of interior surface 36.

The framing device 30 is assembled by compiling workpieces having matching exterior surface 32, interior surface 36, angled surface 38, top surface 34, bottom surface 50 and channel 48. The workpieces are constructed of wood in the preferred embodiment, but it is within the scope of the present invention to have substitute suitable framing material such as plastics and metals. The workpieces are arranged so that they form the desired shape of the frame. In the preferred embodiment, there are two longer workpieces facing opposite of each other connected by two shorter workpieces also facing opposite each other, the four forming rectangle. For this shape, the workpieces are cut with the 45 degree mitred cut 42 such that the assembled workpieces form right angles. Other embodiments utilizing different configurations, such as triangle would use a different mitred cut, such as a 30 and a 60 degree angle. The workpieces may be joined by any typical wood joining method such as the application of adhesive, the use of nails or screws or the insertion of a staple.

Once the framing structure 30 is assembled, a sheet of artist canvas or other suitable material for framing 40 is draped over the surface and stretched so that it is solely touching the top surface edge 34 and is taut in the middle. As can be seen in FIG. 3, there is no longer an indentation line as in the prior art. The canvas 40 is draped over top surface 34, folded along exterior surface 32 and folded under bottom surface 50 with the excess material folded into channel 48. After the material 40 has been stretched tightly and inserted into channel 48, a rubber spline 46 is inserted into channel such that it holds the canvas to the frame as demonstrated in FIG. 6. At this point, the attachment of the canvas to the frame may be reinforced by the use of additional staples (not shown), but they are not required.

As would be understood, different embodiments eliminating one or more of the surfaces is considered within the scope of the present invention. For example, an alternate embodiment could eliminate the use of the angled surface. However, the frame would still have the profile defined from the top surface to the interior surface as described in the present invention. Additionally, other embodiments could either remove the exterior or interior surfaces and still be within the scope of the present invention.

When utilizing the present invention in the painting, the artist typically paints solely on the stretched canvas 40, not painting on any canvas portion that has a wood support directly underneath. Because the canvas surface 40 is held taut solely by top surface edges 34 and angled portion 38 does not touch the canvas 40 in any way, the present invention increases the surface area in which an artist may effectively paint on a stretched canvas 40.

In the foregoing specification, the present invention has been described with reference to specific exemplary embodiments thereof. The invention is considered to have been described in such full, clear and concise terms as to enable a person or ordinary skill in the art to make and use the same. It will be apparent to those skilled in the art that a person understanding this invention may conceive of changes or other embodiments or variations, which utilize the principles of this invention without departing from the broader spirit and scope of the invention as set forth in dependent claims. All are considered within the sphere, spirit and scope of the invention. The specifications and drawings are, therefore, to be regarded in an illustrative rather than a restrictive sense. Accordingly, it is not intended that the invention be limited except as may be necessary in view of the pendant claims or their equivalents which particularly point out and distinctly claim the subject matter applicants regard as their invention.

What is claimed is:

1. A stretcher bar frame, the frame comprising:

a substantially vertical exterior surface;

a substantially vertical interior surface, the interior surface substantially parallel to the exterior surface;

a substantially horizontal top surface, the top surface abutting an upper portion of the exterior surface;

a substantially horizontal bottom surface, the bottom surface contacting a lower portion of the exterior surface and a lower portion of the interior surface, wherein the bottom surface includes a channel parallel to the exterior surface and of a thickness less than a length of the interior surface; and an angled surface, the angled surface coupled to the top surface and to an upper portion of the interior surface, wherein the angled surface defines a profile of the frame, the profile angled such that the angled surface and the interior surface do not break a horizontal plane intersecting the top surface.

2. The stretcher bar frame as recited in claim 1, wherein a material is stretched across the top surface and is further folded over the bottom surface and into the channel.

3. The stretcher bar frame as recited in claim 2 further comprising a spline, the spline inserted into the channel thereby securing the material to the frame.

4. The stretcher bar frame as recited in claim 3, wherein the spline is composed of rubber.

* * * * *